US008279121B2

(12) United States Patent
Ishizuka et al.

(10) Patent No.: US 8,279,121 B2
(45) Date of Patent: Oct. 2, 2012

(54) ANTENNA DEVICE AND WIRELESS COMMUNICATION APPARATUS

(75) Inventors: Kenichi Ishizuka, Yokohama (JP); Kazunari Kawahata, Yokohama (JP); Nobuhito Tsubaki, Yokohama (JP); Shigeyuki Fujieda, Hakusan (JP); Shinichi Nakano, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 446 days.

(21) Appl. No.: 12/504,367

(22) Filed: Jul. 16, 2009

(65) Prior Publication Data

US 2009/0273531 A1 Nov. 5, 2009

Related U.S. Application Data

(63) Continuation of application No. PCT/JP2007/071427, filed on Nov. 2, 2007.

(30) Foreign Application Priority Data

Jan. 19, 2007 (JP) ..... 2007-010139

(51) Int. Cl.
*H01Q 1/38* (2006.01)

(52) U.S. Cl. ..... 343/700 MS; 343/750; 343/751

(58) Field of Classification Search ..... 343/722–723, 343/750–752, 852, 861, 702, 700 MS
See application file for complete search history.

(56) References Cited

U.S. PATENT DOCUMENTS 6,281,850 B1 8/2001 Klostermann
6,501,425 B1 * 12/2002 Nagumo et al. ..... 343/700 MS
6,600,449 B2 7/2003 Onaka et al.
6,606,069 B2 * 8/2003 Kitamura et al. ..... 343/745
7,180,463 B2 * 2/2007 Chung ..... 343/824

(Continued)

FOREIGN PATENT DOCUMENTS

JP 02-016476 A 1/1990

(Continued)

OTHER PUBLICATIONS

Official Communication issued in corresponding Japanese Patent Application No. 2008-528266, mailed on Jul. 21, 2010.

(Continued)

*Primary Examiner* — Tho G Phan
(74) *Attorney, Agent, or Firm* — Keating & Bennett, LLP

(57) ABSTRACT

A compact and low-cost antenna device in which no interference occurs even when many antenna units corresponding to various systems are mounted close together in a small area, and a wireless communication apparatus including the antenna device. An antenna device includes plural antenna units mounted on a single dielectric base. A first antenna unit having a lowest fundamental frequency is disposed at a left end of a non-ground region, a second antenna unit having a highest fundamental frequency of the plurality of the antenna units is disposed at a right end of the non-ground region, and a third antenna unit having a fundamental frequency between those of the first antenna unit and the second antenna unit is disposed between the first and second antenna units. A current-density control coil is connected between a first radiation electrode and a power feeder of the first antenna unit, while a reactance circuit is disposed in the middle of the first radiation electrode. Notches may be disposed between the first radiation electrode and a second radiation electrode and between the first radiation electrode and a third radiation electrode.

8 Claims, 10 Drawing Sheets

U.S. PATENT DOCUMENTS

| | | | | |
|---|---|---|---|---|
| 7,310,068 | B2 * | 12/2007 | Hu et al. | 343/702 |
| 7,369,092 | B1 * | 5/2008 | Wen et al. | 343/702 |
| 7,375,695 | B2 * | 5/2008 | Ishizuka et al. | 343/745 |
| 7,466,277 | B2 | 12/2008 | Ishizuka et al. | |
| 7,586,446 | B2 * | 9/2009 | Sakama et al. | 343/702 |
| 7,710,325 | B2 * | 5/2010 | Cheng | 343/700 MS |
| 7,760,150 | B2 * | 7/2010 | Sato | 343/724 |
| 2002/0030626 | A1 | 3/2002 | Nagumo et al. | |
| 2002/0075186 | A1 * | 6/2002 | Hamada et al. | 343/700 MS |
| 2002/0105474 | A1 | 8/2002 | Kitamura et al. | |
| 2002/0190907 | A1 | 12/2002 | Konishi et al. | |
| 2007/0139282 | A1 * | 6/2007 | Haruyama | 343/702 |

FOREIGN PATENT DOCUMENTS

| | | |
|---|---|---|
| JP | 2-24401 | 5/1990 |
| JP | 2001-298313 | 10/2001 |
| JP | 2002-158529 | 5/2002 |
| JP | 2002-232313 | 8/2002 |
| JP | 2002-314330 | 10/2002 |
| JP | 2002-374115 | 12/2002 |
| JP | 2004-112397 | 4/2004 |
| WO | 2004/109850 | 12/2004 |
| WO | 2006/134701 | 12/2006 |

OTHER PUBLICATIONS

Written Opinion with English language translation.

International Search Report issued Jan. 8, 2008 with English language translation.

* cited by examiner

ANTENNA DEVICE AND WIRELESS COMMUNICATION APPARATUS

CROSS-REFERENCE TO RELATED APPLICATIONS

This is a continuation under 35 U.S.C. §111(a) of PCT/JP2007/071427 filed Nov. 2, 2007, and claims priority of JP2007-010139 filed Jan. 19, 2007, both incorporated by reference.

BACKGROUND

1. Technical Field

The present invention relates to frequency-adjustable antenna devices, and particularly to an antenna device and a wireless communication apparatus for multisystem communication.

2. Background Art

Examples of known techniques relating to antenna devices of this type are described in Patent Document 1 and Patent Document 2.

Patent Document 1 describes a frequency variable antenna having a loop-shaped radiation electrode that performs a monopole antenna operation. The frequency variable antenna is provided with a frequency variable circuit in the middle of the radiation electrode. Thus, by externally applying a voltage to the frequency variable circuit to vary a reactance component of the frequency variable circuit, it is possible to vary the frequency while maintaining good gain.

Patent Document 2 describes an antenna device having an antenna main body and a variable capacitance diode that forms a resonant circuit at a base of the antenna main body. By applying a tuning voltage to vary the electrostatic capacitance of the variable capacitance diode, a desired frequency can be obtained.

Recently, as mobile phones have become multifunctional, it has become necessary to mount various systems of different frequencies on the same substrate. To realize such a multifunctional mobile phone, it is necessary to mount many antenna units corresponding to various systems close together in a small antenna mounting area.

However, when a plurality of antenna units are mounted, if antenna units having close fundamental frequencies are located close together or if a first antenna unit and a second antenna unit having a fundamental frequency close to a harmonic frequency in the first antenna unit are located close together, interference may occur and cause degradation in characteristics of these antenna units.

Moreover, because of enhanced multifunctionality of mobile phones, since a substrate is mostly occupied by functional circuits other than radiation electrodes of antenna units, a mounting area for mounting the radiation electrodes is reduced. At the same time, as the size of mobile phones shrinks, a mounting area for mounting radiation electrodes becomes extremely small.

Thus, under circumstances where it is necessary to mount radiation electrodes of antenna units for various systems in a very small area, antenna units having close frequencies need to be arranged close together.

Therefore, it is hoped that there will be developed an antenna device in which no interference occurs even if many antenna units corresponding to various systems are mounted close together in a small area.

Patent Document 1: PCT International Publication No. WO2004/109850

Patent Document 2: Japanese Unexamined Patent Application Publication No. 2002-232313

However, with the foregoing known techniques, it is difficult to meet the expectation described above.

Specifically, in the frequency variable antenna described in Patent Document 1, a current density in a radiation electrode extending from a power feeder to a frequency variable circuit is very high. Therefore, if a number of such antennas are arranged close together, currents flowing through bases of antennas having close fundamental frequencies may cause very strong coupling of magnetic fields, and interference may occur between these antennas. This may result in deterioration in isolation between antennas and degradation of antenna gain.

Additionally, since components are mounted on a surface of a substrate to form a frequency variable circuit, these components protrude from the surface of the substrate by the thicknesses of these components. This not only hinders a size reduction in the direction of thickness of the mobile phone, but also causes a problem of strength of component mounting.

In the antenna device described in Patent Document 2, current densities of both fundamental waves and harmonics are very high at the base of the antenna main body. Therefore, by increasing the inductance of a matching circuit at the base of the antenna main body, fundamental waves and harmonics can be changed simultaneously. However, if a fundamental frequency is changed, the corresponding harmonic frequency is changed by an amount as much as several times greater than the amount of change of the fundamental frequency. Thus, since fundamental waves and harmonics cannot be independently controlled, the harmonic frequency may overlap with the fundamental frequency of another system, and thus, mutual interference may occur.

Thus, with the techniques described in Patent Documents 1 and 2, it is difficult to simultaneously solve the problem of interference between fundamental frequencies and the problem of interference between a harmonic frequency and a fundamental frequency. Even if a number of these antenna devices are mounted, it is not possible to meet the expectation described above.

Moreover, in the techniques described above, when many antenna units are put together in one place, radiation electrodes and the like of the respective antenna units are disposed on different substrates. This means that costs involved in forming a radiation electrode and the like on each substrate are multiplied by the number of antenna units. Additionally, when antenna units individually designed are integrated into one place, since their characteristics may be changed depending on the installation conditions, each antenna unit needs to be adjusted in response to the changes in characteristics. This makes the process more complicated.

SUMMARY

The embodiments disclosed herein provide solutions to the problems described above. Disclosed is a compact and low-cost antenna device in which no interference occurs even if many antenna units corresponding to various systems are mounted close together in a small area. Also disclosed is a wireless communication apparatus including the antenna device.

To solve the problems described above, an antenna device may include a plurality of antenna units each having a power feeder and a radiation electrode, a circuit board having an antenna mounting area on which the plurality of antenna units are mounted, and a dielectric base on which all or part of the radiation electrodes of the respective antenna units are formed. Of the plurality of antenna units, a first antenna unit having a lowest fundamental frequency is disposed at an end of the antenna mounting area, a second antenna unit having a highest fundamental frequency of the plurality of antenna units is disposed more distantly from the first antenna unit than the other one or more antenna units are from the first antenna unit, and the other one or more antenna units are interposed between the first and second antenna units and in parallel therewith. A current-density control circuit capable of controlling a current density in the radiation electrode is interposed between the radiation electrode and the power feeder of the first antenna unit, while a reactance circuit for adjusting a frequency by varying an electrical length of the radiation electrode of the first antenna unit is disposed in the middle of the radiation electrode of the first antenna unit.

With this configuration, the plurality of antenna units allow communication in different systems. Specifically, the first antenna unit allows communication at lowest frequencies, the second antenna unit allows communication at higher frequencies, and the other one or more antenna units allow communication at the other frequencies.

When communication is performed using the first antenna unit, if the power feeder of one of the other one or more antenna units having a fundamental frequency close to that of the first antenna unit is located close to the first antenna unit, since current densities at the bases of the radiation electrodes of the respective antenna units are high, the currents may cause magnetic field coupling, and thus, the performance of the first antenna unit and the antenna gain of the first antenna unit may be degraded.

However, in the disclosed embodiments, the current-density control circuit is disposed between the radiation electrode and the power feeder of the first antenna unit. With the current-density control circuit, it is possible to set a reduced current density in the radiation electrode. Thus, magnetic field coupling between the first antenna unit and the other antenna unit close to the first antenna unit can be prevented. Therefore, by providing the first antenna unit at an end of the antenna mounting area and providing the other antenna unit near the power feeder of the first antenna unit, many antenna units can be mounted within a small antenna mounting area.

In the second antenna unit having a fundamental frequency greatly different from that of the first antenna unit and the highest fundamental frequency of the plurality of antenna units, the harmonics in the first antenna unit may cause electric and magnetic field coupling. Therefore, the second antenna unit is disposed more distantly from the first antenna unit than the other one or more antenna units are from the first antenna unit. However, depending on the size of the antenna mounting area, the distance between the first antenna unit and the second antenna unit may not be sufficient. As a result, the second antenna unit may be electrically coupled with harmonics in the first antenna unit.

However, in the disclosed embodiments, the reactance circuit is disposed in the middle of the radiation electrode of the first antenna unit. With the reactance circuit, it is possible to set a harmonic frequency in the first antenna unit that is separated from the fundamental frequency of the second antenna unit. Thus, electrical coupling between the first antenna unit and the second antenna unit can be prevented.

According to various embodiments, at least one of the radiation electrodes of the respective antenna units is formed on the single dielectric blase, while one or more notches for reducing capacitance between radiation electrodes of any of the first antenna unit, the second antenna unit, and the other one or more antenna units are disposed at a portion of the dielectric base and between the radiation electrodes.

With this configuration, since at least one of the radiation electrodes of the respective antenna units is formed on the single dielectric base, the manufacturing costs can be made lower than those in the case where the radiation electrodes of the respective antenna units are disposed on different dielectric bases. Moreover, since there is no need for adjustment of each antenna unit, a simple manufacturing process can be realized. At the same time, since capacitance between the radiation electrodes by which the one or more notches are interposed is reduced, interference between these radiation electrodes can be reduced.

According to various embodiments, a recess is provided on a surface of the dielectric base, and a substrate on which the reactance circuit is formed is disposed inside the recess.

In this configuration, components are mounted on the substrate in a different process to form the reactance circuit, and then, the substrate is inserted into the recess on the surface of the dielectric base. Therefore, the reactance circuit can be easily mounted in the middle of the radiation electrode of the first antenna unit. With this configuration, the components of the reactance circuit are hidden inside the recess and do not protrude from the dielectric base. Also, mounting on the curved surface of the dielectric base is made possible.

According to various embodiments, the current-density control circuit is a current-density control coil connected in series between the power feeder and the radiation electrode of the first antenna unit.

With this configuration, magnetic field coupling between the first antenna unit and another antenna unit having a fundamental frequency close to that of the first antenna unit can be prevented with a simple structure.

According to various embodiments, the reactance circuit is a series resonant circuit or a parallel resonant circuit and includes one or more capacitors and one or more inductors.

With this configuration, in which a series resonant circuit or a parallel resonant circuit is used as the reactance circuit, high impedance can be applied to the radiation electrode of the first antenna unit at specific frequencies. Thus, it is possible to effectively control the frequency of harmonics produced in the first antenna unit.

According to various embodiments, any or all of the one or more capacitors in the reactance circuit may be variable capacitance elements, and a control voltage input provided for applying a control voltage to vary each capacitance value of the one or more variable capacitance elements, and thus vary a reactance value of the reactance circuit.

In this configuration, after the reactance circuit is mounted inside the recess, a control voltage is applied to the one or more variable capacitance elements, and thus the electrical length of the radiation electrode of the first antenna unit can be freely changed.

According to various embodiments, one or more branched radiation electrodes are branched from the radiation electrode of the first antenna unit via the reactance circuit, and the whole or part of the one or more branched radiation electrodes is disposed on the dielectric base.

With this configuration, the first antenna unit can serve as a multi-resonant antenna, and the number of fundamental frequencies that can be obtained from a single power feeder increases.

According to various embodiments, a portion of the radiation electrode of the first antenna unit, extending from the reactance circuit and being adjacent to an extremity of the antenna device, or any of the one or more branched radiation electrodes, is disposed on an exposed surface of the dielectric base, and the portion of the radiation electrode or the branched radiation electrode is electrically connected to the reactance circuit via a conductive path extending from a bottom of the recess to the exposed surface.

With this configuration, part of the radiation electrode of the first antenna unit or the branched radiation electrode can be disposed on an exposed surface different from the surface where the radiation electrode is disposed.

A wireless communication may include an RF source, connected to the antenna device according to any one of the disclosed embodiments.

As described above in detail, in the antenna device, since the current-density control circuit makes it possible to reduce a current density in the radiation electrode of the first antenna unit, it is possible to prevent magnetic field coupling between the first antenna unit and another antenna unit having a fundamental frequency close to that of the first antenna unit. Additionally, since the second antenna unit having a fundamental frequency close to a harmonic frequency in the first antenna unit is disposed at a position most distant from the first antenna unit and, at the same time, the reactance circuit is provided, interference between the first and second antenna units can be prevented. Therefore, many antenna units can be densely mounted on a small antenna mounting area. This has an excellent effect of realizing a high-density and compact antenna device.

Since at least one of the radiation electrodes of the respective antenna units is formed on the single dielectric base, reduced manufacturing costs and an easier manufacturing process can be realized. Additionally, the one or more notches make it possible to effectively reduce interference between radiation electrodes.

Unlike the case where components are directly mounted on the surface of the dielectric base, even if the surface of the dielectric base is curved, the substrate having the reactance circuit thereon can be easily mounted on the surface of the dielectric base. Moreover, since the components do not protrude from the dielectric base, the dielectric base can be shaped to match the shape of terminal equipment without being limited by mounting of the reactance circuit, and thus a compact antenna device can be realized.

Magnetic field coupling between the first antenna unit and another antenna unit having a fundamental frequency close to that of the first antenna unit can be prevented with a simple structure.

It is possible to effectively control the frequency of harmonics produced in the first antenna unit.

By applying a control voltage to the one or more variable capacitance elements, the electrical length of the radiation electrode of the first antenna unit can be freely changed. Therefore, with the reactance circuit, it is possible to compensate for a reduction in bandwidth associated with a reduction in size of the antenna device, and thus to provide a compact antenna device having a wide bandwidth.

Since the first antenna unit can be configured as a multi-resonant antenna, the number of power feeders becomes smaller than that of radiation electrodes. This makes it possible to increase the distance between power feeders and reduce coupling between radiation elements. Additionally, since the first antenna unit configured as a multi-resonant antenna has a wider bandwidth, it is possible to provide a compact and wideband antenna device.

Since part of the radiation electrode of the first antenna unit or the branched radiation electrode can be disposed on any exposed surface including a surface different from the surface where the radiation electrode is disposed, it is possible to increase the degree of freedom of arrangement of the branched radiation electrode and the like, further reduce the size of the antenna device, improve antenna efficiency, and reduce interference between antenna units.

It is possible to provide a compact and high-density wireless communication apparatus capable of performing multi-system communication.

Other features and advantages will become apparent from the following description of embodiments, which refers to the accompanying drawings.

DETAILED DESCRIPTION

Reference Numerals

Figure 1:
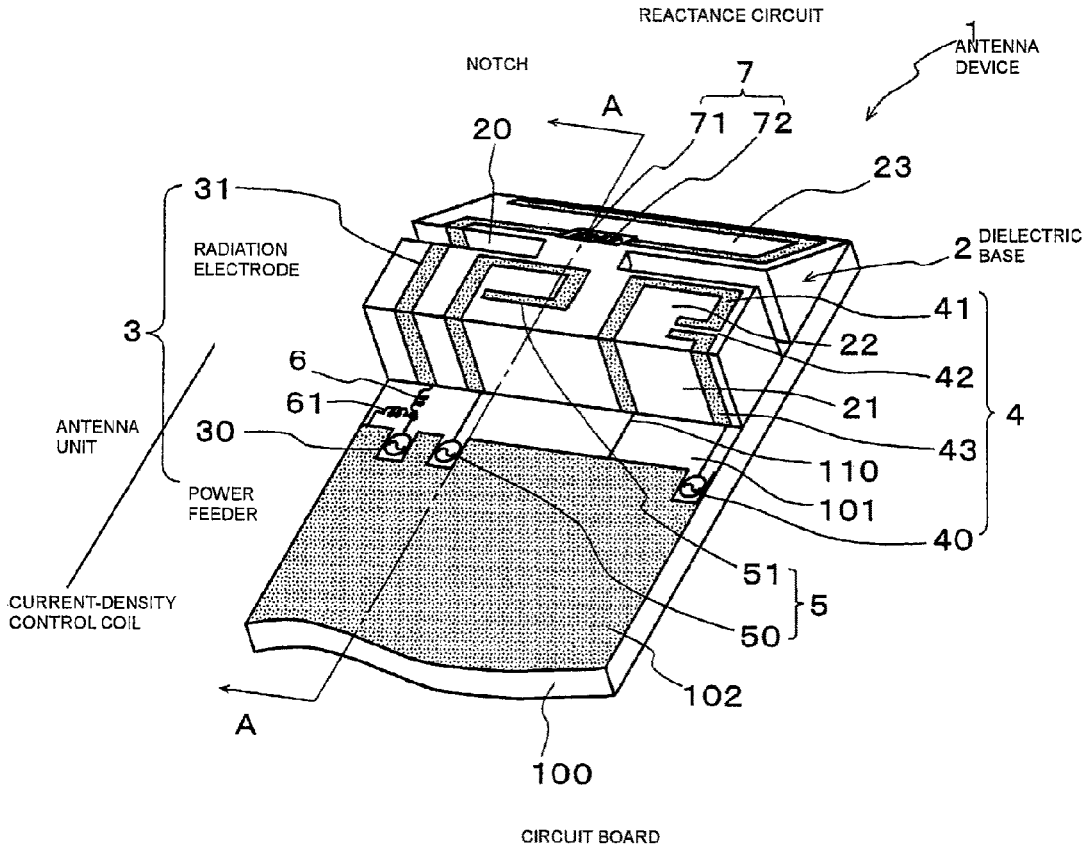
FIG. 1 is a perspective view of an antenna device according to a first embodiment.

1: antenna device
2: dielectric base
3 to 5: antenna unit

6: current-density control coil
7, 7': reactance circuit
20: notch
21: front surface
22: upper surface
23: inclined surface
24, 25: exposed surface
29: recess
30, 40, 50: power feeder
31, 32, 41, 51: radiation electrode
31*a*: base portion of radiation electrode
31*b*: extremity portion of radiation electrode
32*a*: branched radiation electrode
60: direct-current power supply
70: dielectric substrate
71: capacitor
71': variable capacitance capacitor
72: inductor
73: resistor
100: circuit board
101: non-ground region
102: ground region
Vc: control voltage Embodiments will now be described with reference to the drawings.

First Embodiment

Figure 2:
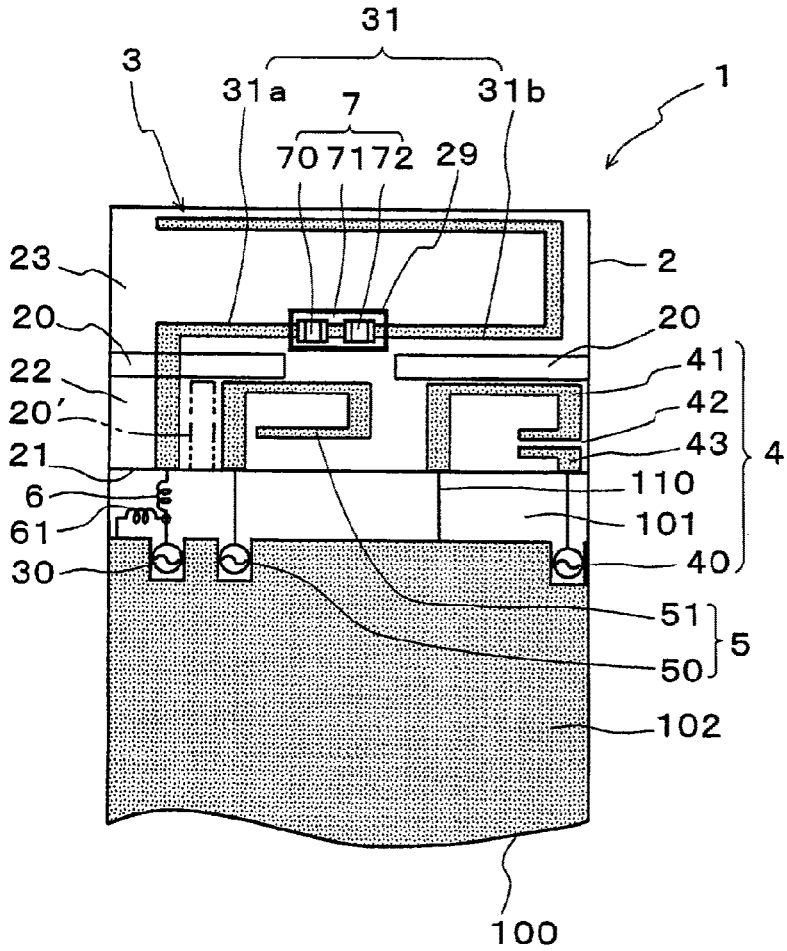
FIG. 2 is a plan view of the antenna device.
Figure 3:
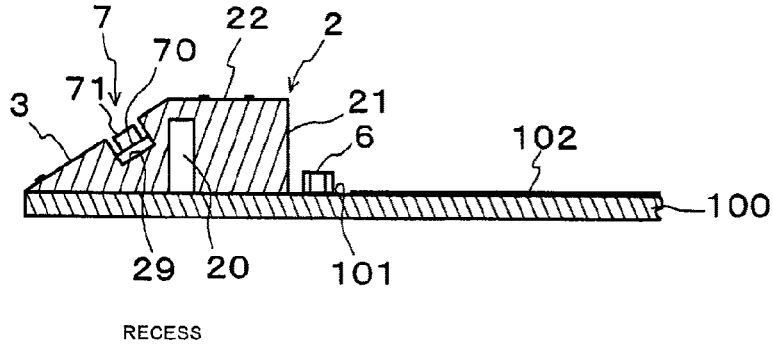
FIG. 3 is a cross section as viewed in the direction of arrow A-A of FIG. 1.

FIG. 1 is a perspective view of an antenna device according to a first embodiment. FIG. 2 is a plan view of the antenna device. FIG. 3 is a cross section as viewed in the direction of arrow A-A of FIG. 1.

As illustrated in FIG. 1, an antenna device 1 of the present embodiment is a multisystem antenna device for being included in a wireless communication apparatus, such as a mobile phone or a PC card, and mounted on a circuit board 100 to be included in the wireless communication apparatus.

Specifically, the antenna device 1 is formed by providing a single dielectric base 2 on a non-ground region 101, which serves as an antenna mounting area, and mounting three antenna units 3, 4, and 5 on the dielectric base 2.

The dielectric base 2 is integrally molded with dielectric material, positioned near an extremity of the antenna device 1 (i.e., on the upper end as seen in FIG. 1), and secured to the non-ground region 101.

Specifically, the dielectric base 2 has a vertical front surface 21, a horizontal upper surface 22, an inclined surface 23 continuous with the upper surface 22 and extending downward toward the extremity of the antenna device 1. At the same time, the dielectric base 2 has a notch 20 on the boundary between the upper surface 22 and the inclined surface 23.

Of the three antenna units, the antenna unit 3 serves as a first antenna unit having the lowest fundamental frequency. In the present embodiment, the antenna unit 3 is an antenna for digital terrestrial television and has a fundamental frequency range of 470 MHz to 770 MHz.

As illustrated in FIG. 1 and FIG. 2, the antenna unit 3 includes a power feeder 30 and a radiation electrode 31 and is located at the left end of the non-ground region 101.

A current-density control coil 6 serving as a current-density control circuit is connected in series between a base of the radiation electrode 31 and the power feeder 30, while a matching-circuit parallel coil 61 which is grounded is connected between the current-density control coil 6 and the power feeder 30. The current-density control coil 6 is provided to reduce current density between the base of the radiation electrode 31 and a reactance circuit 7 described below.

The radiation electrode 31 is mostly formed on the dielectric base 2. Specifically, on the dielectric base 2, the radiation electrode 31 extends from the front surface 21 to the upper surface 22, passes inside the notch 20, and further extends up to the inclined surface 23. On the inclined surface 23, the radiation electrode 31 is bent to the right, extends along the top edge of the inclined surface 23, extends downward along the right edge of the inclined surface 23 to the bottom edge, and then extends leftward along the bottom edge of the extremity of the inclined surface 23 until the tip of the radiation electrode 31 reaches the left corner at the extremity of the inclined surface 23.

The reactance circuit 7 is disposed in the middle of the radiation electrode 31. The reactance circuit 7 is a circuit for varying the electric length of the radiation electrode 31 to adjust the frequency of the antenna unit 3.

Figure 4:
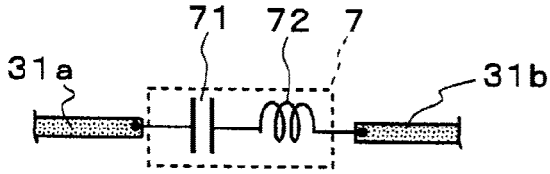
FIG. 4 is a circuit diagram illustrating a reactance circuit of the first embodiment.

FIG. 4 is a circuit diagram illustrating the reactance circuit 7 of the present embodiment.

As illustrated in FIG. 4, the reactance circuit 7 to which the present embodiment is applied is a series resonant circuit including a capacitor 71 and an inductor 72.

As illustrated in FIG. 2 and FIG. 3, the reactance circuit 7 is formed on a dielectric substrate 70 and inserted into a recess 29 in the inclined surface 23 of the dielectric base 2. Specifically, the recess 29 is located on the radiation electrode 31 and formed near the second point at which the current density of harmonics in the antenna unit 3 is highest. Therefore, as illustrated in FIG. 2, the radiation electrode 31 is divided at the recess 29 into a base portion 31*a* near the base of the radiation electrode 31 and an extremity portion 31*b* near the extremity of the antenna device 1. Then, the dielectric substrate 70 on which the reactance circuit 7 is formed is inserted into the recess 29, an open end (located on the left in FIG. 4) of the capacitor 71 is connected to the base portion 31*a* of the radiation electrode 31, an open end (located on the right in FIG. 4) of the inductor 72 is connected to the extremity portion 31*b* of the radiation electrode 31, and thus the base and extremity portions 31*a* and 31*b* of the radiation electrode 31 are electrically connected to each other via the reactance circuit 7.

In the present embodiment, as described above, the dielectric substrate 70 having the reactance circuit 7 formed thereon in a different process is inserted into the recess 29 of the dielectric base 2, and thus mounting of the reactance circuit 7 is simplified. Therefore, the capacitor 71 and the inductor 72, which are components of the reactance circuit 7, are hidden inside the recess 29 and do not protrude from the dielectric base 2. As a result, as illustrated in FIG. 1 and FIG. 3, the shape of the dielectric base 2 can be determined without being limited by mounting of the reactance circuit 7. In the present embodiment, the upper surface of the dielectric base 2 is a bent surface including the upper surface 22 extending horizontally and the inclined surface 23 extending downward, and thus compactness of the antenna device 1 can be achieved.

The antenna unit 4 illustrated in FIG. 1 serves as a second antenna unit having a highest fundamental frequency of the plurality of antenna units. In the present embodiment, the antenna unit 4 is an antenna for global positioning system (GPS) communication and has a fundamental frequency of about 1575 MHz.

As illustrated in FIG. 1 and FIG. 2, the antenna unit 4 includes a power feeder 40 and a radiation electrode 41 and is located at the right end of the non-ground region 101. That is, to avoid interference caused by harmonics in the antenna unit 3, the antenna unit 4 is disposed at a position most distant from the antenna unit 3 (disposed at a greater distance from the first antenna unit 3 than the distance between the third antenna unit 5 and the first antenna unit 3).

The antenna unit 4 is a magnetic-field radiation antenna terminated with large capacitance by the non-ground region 101. An end of the radiation electrode 41 is grounded to a conductive trace 110 on the non-ground region 101 and power from the power feeder 40 is input via a capacitive part 42. The degree of coupling of a magnetic-field radiation antenna of this type with adjacent antennas is small. Therefore, when the antenna unit 4 is disposed away from the other antenna units, the degree of coupling can be further reduced.

The radiation electrode 41 of the antenna unit 4 is also mostly formed on the dielectric base 2. Specifically, an electrode part 43 electrically connected to the power feeder 40 is formed at a front right corner of the upper surface 22 of the dielectric base 2. A base portion of the radiation electrode 41 is disposed opposite the electrode part 43. The base portion of the radiation electrode 41 extends close to the electrode part 43, then toward the extremity of the antenna device 1 and up to the right rear corner of the upper surface 22. Then, the radiation electrode 41 is bent to the left, extends further, and is bent back to the front. Then, the radiation electrode 41 extends downward along the front surface 21. Thus, the leading end of the radiation electrode 41 is electrically connected to a ground region 102 via a conductive trace 110 formed on the non-ground region 101.

The antenna unit 5 serves as the other antenna unit (the third antenna unit in this example) and has a fundamental frequency between the frequencies of the antenna unit 3 and the antenna unit 4. In the present embodiment, the antenna unit 5 is a dual-resonant antenna for evolution data only (EVDO) communication and has a fundamental frequency range of 843 MHz to 875 MHz and a harmonic frequency range of 2.115 GHz to 2.130 GHz.

As illustrated in FIG. 1 and FIG. 2, the antenna unit 5 includes a power feeder 50 and a radiation electrode 51 and is located on the left side of the non-ground region 101. That is, the antenna unit 5 is disposed between the antenna unit 3 and the antenna unit 4.

The radiation electrode 51 of the antenna unit 5 is also mostly formed on the dielectric base 2. Specifically, while being connected to the power feeder 50, the radiation electrode 51 extends from a base of the front surface 21, the base being located at a lower end of the front surface 21. The radiation electrode 51 extends upward along the front surface 21, further extends straight back along the upper surface 22 toward the extremity of the antenna device 1, and is bent to form an inverted C shape at one side of the notch 20 distant from the extremity of the antenna device 1.

The capacitance of the radiation electrodes 31, 41, and 51 of the three antenna units 3, 4, and 5, respectively, is reduced by the notch 20.

Specifically, as illustrated in FIG. 2, capacitance between the base portion 31*a* of the radiation electrode 31 and the radiation electrode 51 is reduced by a left portion of the notch 20, while capacitance between the extremity portion 31*b* of the radiation electrode 31 and the radiation electrode 41 is reduced by a right portion of the notch 20.

While not applied in the present embodiment, by providing a notch 20' (indicated by a chain double-dashed line in FIG. 2) between the bases of the radiation electrode 31 and radiation electrode 51 that are strongly electrically coupled to each other, it is possible to further effectively prevent interference between the antenna units 3 and 5.

As described above, in the present embodiment, most parts of the radiation electrodes 31, 41, and 51 of the antenna units 3, 4, and 5, respectively, are formed on the single dielectric base 2. This not only reduces manufacturing costs, but also simplifies the manufacturing process.

Next, the operation and effects of the antenna device of the present embodiment will be described.

Figure 5:
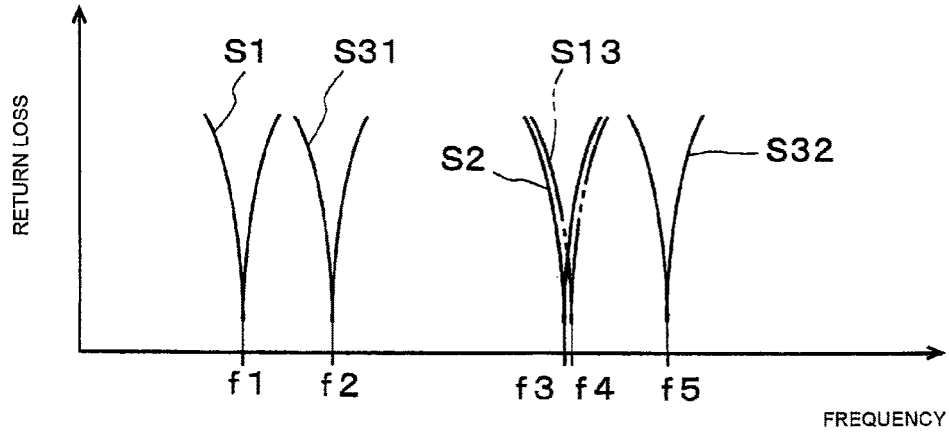
FIG. 5 is a graph showing return losses of antenna units in a state where a current-density control coil and the reactance circuit are not present.
Figure 6:
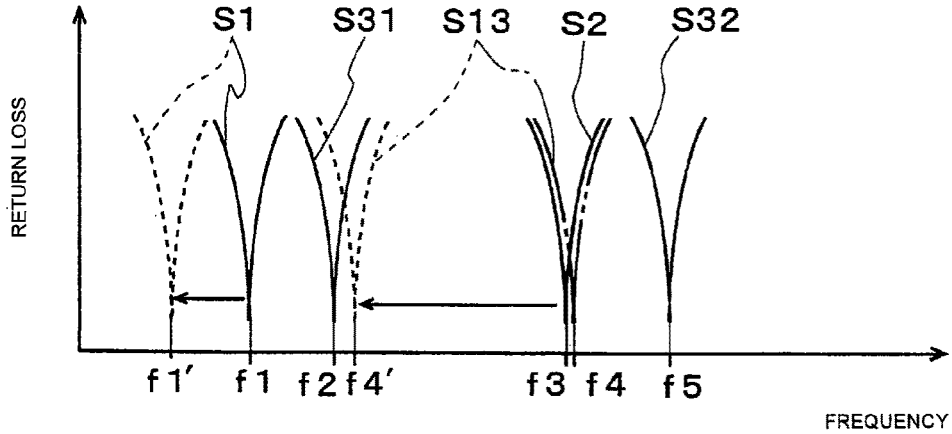
FIG. 6 is a graph showing return losses of the antenna units in a state where adjustment is made by the current-density control coil.
Figure 7:
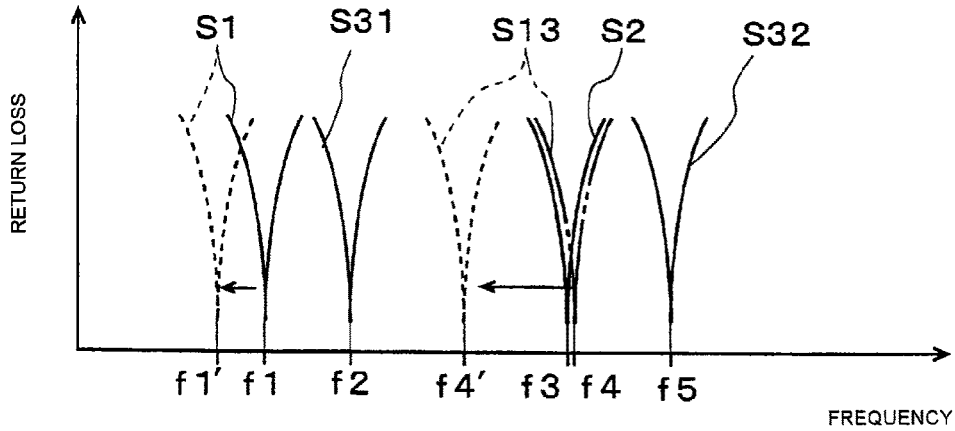
FIG. 7 is a graph showing return losses of the antenna units in a state where adjustment is made by the current-density control coil and the reactance circuit.

FIG. 5 is a graph showing return losses of antenna units in a state where the current-density control coil 6 and the reactance circuit 7 are not present. FIG. 6 is a graph showing return losses of the antenna units in a state where adjustment is made by the current-density control coil 6. FIG. 7 is a graph showing return losses of the antenna units in a state where adjustment is made by the current-density control coil 6 and the reactance circuit 7.

As shown in FIG. 5, when the current-density control coil 6 and the reactance circuit 7 that are connected to the radiation electrode 31 of the antenna unit 3 are not present, the antenna unit 3 can be used at a fundamental frequency f1 in the 470 MHz to 770 MHz range (return loss curve S1), the antenna unit 4 can be used at a fundamental frequency f3 of about 1575 MHz (return loss curve S2), and the antenna unit 5 can be used at a frequency f2 in the 843 MHz to 875 MHz range (return loss curve S31) and at a frequency f5 in the 2.115 GHz to 2.130 GHz range (return loss curve S32).

That is, when a communication apparatus, such as a mobile phone, including the antenna device 1 of the present embodiment is used, it is possible to simultaneously execute digital terrestrial television, GPS communication, and EVDO communication.

As shown in FIG. 5, the fundamental frequency f1 of the antenna unit 3 and the frequency f2 of the antenna unit 5 are close to each other. In this state, the antenna units 3 and 5 may be strongly electrically coupled to each other, and thus antenna gain may be degraded.

Figure 8:
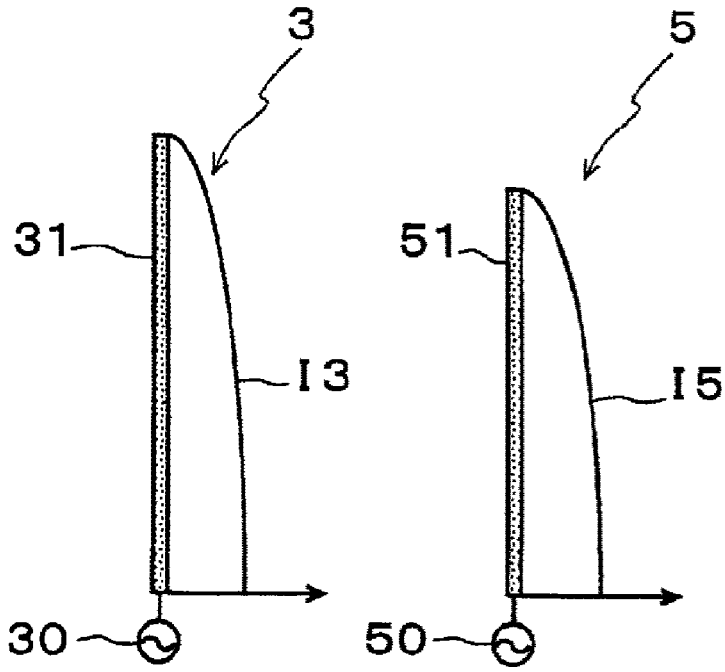
FIG. 8 is a schematic view showing distributions of current densities at the fundamental frequencies of the antenna units.
Figure 9:
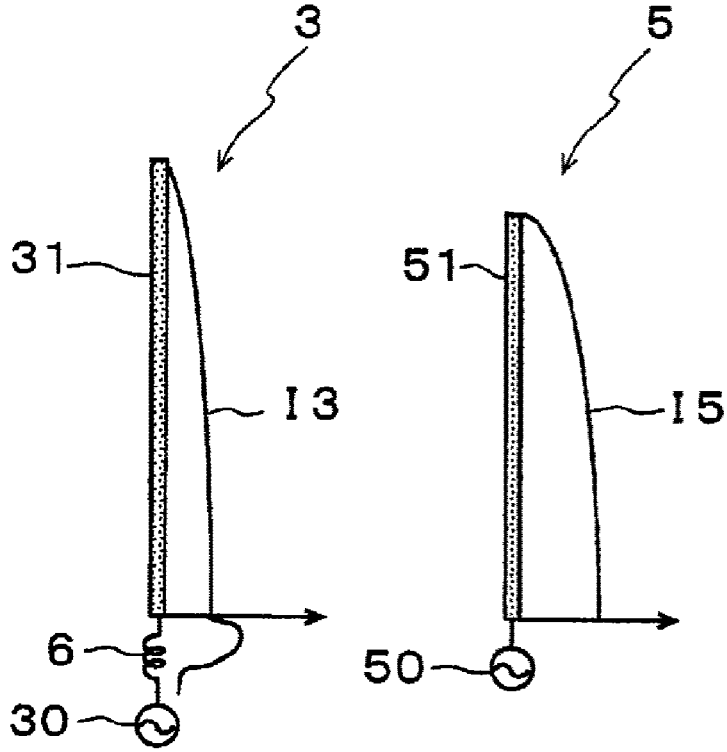
FIG. 9 is a schematic view showing distributions of current densities adjusted by the current-density control coil.

FIG. 8 is a schematic view showing distributions of current densities at the fundamental frequencies of the antenna unit 3 and antenna unit 5. FIG. 9 is a schematic view showing distributions of current densities adjusted by the current-density control coil 6.

That is, as shown in FIG. 8, the antenna units 3 and 5 having close fundamental frequencies exhibit similar distributions of high current densities I3 and I5. In particular, since the current densities I3 and I5 in base parts of the radiation electrodes 31 and 51 (i.e., in portions of the radiation electrodes 31 and 51, the portions being formed on the front surface 21 of the dielectric base 2) are high, currents that flow through these base parts cause magnetic field coupling between the radiation electrodes 31 and 51.

However, as illustrated in FIG. 1 and FIG. 2, in the antenna device 1 of the present embodiment, the radiation electrode 31 is provided with the current-density control coil 6. Therefore, it is possible to set the inductance value of the current-density control coil 6 such that the current density in the radiation electrode 31 is reduced.

Thus, as shown in FIG. 9, the current density I3 in the radiation electrode 31 becomes smaller than the current density I5 in the radiation electrode 51 of the antenna unit 5, and magnetic field coupling between the radiation electrodes 31 and 51 can be prevented.

As shown in FIG. 5, in the antenna unit 3, a harmonic (return loss curve S13) having a frequency f4 that is three times the fundamental frequency f1 is generated and may interfere with the antenna unit 4 having the fundamental frequency f3 closest to the harmonic frequency f4.

Figure 10:
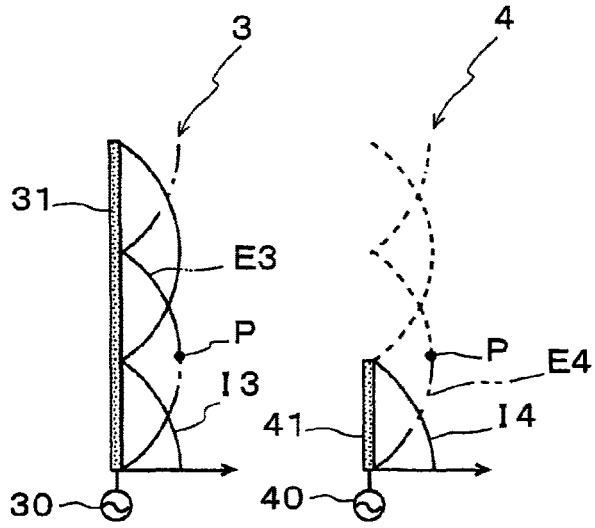
FIG. 10 is a schematic view for illustrating an interference phenomenon caused by harmonics.

FIG. 10 is a schematic view for illustrating an interference phenomenon caused by harmonics.

As shown in FIG. 10, the current density 13 of harmonics in the antenna unit 3 is high. Thus, the current density 13 for the harmonic frequency f4 and a current density 14 for the fundamental frequency f3 of the antenna unit 4 cause strong coupling of magnetic fields. Moreover, as indicated by a chain double-dashed line, since an electric field E3 of the harmonics is generated in the radiation electrode 31, a maximum electric field point P appears at the base of the radiation electrode 31. Therefore, if the antenna units 3 and 4 are located close to each other, the degree of coupling between the electric field E3 of the harmonics and an electric field E4 of the antenna unit 4 is high. However, in the present embodiment, since the antenna unit 4 is disposed at a position most distant from the antenna unit 3, adverse effects of such electric fields and magnetic fields can be reduced.

However, if the non-ground region 101 serving as an antenna mounting area is very small, no matter how distant the antenna unit 4 is from the antenna unit 3, the antenna unit 4 may be affected by the harmonics in the antenna unit 3.

Therefore, in response to such a case, it is advantageous to shift the harmonic frequency f4 in the antenna unit 3 away from the fundamental frequency f3 of the antenna unit 4.

In the present embodiment, the current-density control coil 6 is provided to allow the fundamental frequency f1 to be slightly shifted. Therefore, accordingly, the harmonic frequency f4 is shifted away from the fundamental frequency f3.

However, if only the current-density coil 6 is taken into account, the frequency f4 is shifted by an amount as much as three times the amount of shift of the fundamental frequency f1. Therefore, if the current-density control coil 6 lowers the fundamental frequency f1, the harmonic frequency f4 approaches a frequency f4' near the frequency f2, as indicated by a dashed line in FIG. 6, and thus may cause interference. However, if the fundamental frequency f1 is lowered by an amount that does not cause the frequency f4 to approach the frequency f2, a current density in the power feeder cannot be reduced. Therefore, magnetic field coupling between the antenna unit 3 and the antenna unit 5 cannot be avoided. In other words, the fundamental frequency f1 of the antenna unit 3 and the frequency f4 cannot be simultaneously shifted to their respective desired values only by the current-density control coil 6.

However, in the present embodiment shown in FIG. 7, the reactance circuit 7 is provided in the middle of the radiation electrode 31 of the antenna unit 3. Therefore, by setting a reactance value of the reactance circuit 7 to a desired value, the amount of shift of the harmonic frequency f4 can be adjusted.

Specifically, when the reactance circuit 7 is configured as a series resonant circuit including the capacitor 71 and the inductor 72, different reactance values can be provided for respective frequencies, and thus the harmonic frequency f4 can be lowered by a desired amount. Therefore, as shown in FIG. 7, the fundamental frequency f1 of the antenna unit 3 can be sufficiently shifted away from the frequency f2 of the antenna unit 5, and the harmonic frequency f4 can be shifted to the frequency f4' that is sufficiently distant from the frequency f2 of the antenna unit 5 and is not close to the frequency f2 of the antenna unit 5. As a result, interference caused by harmonics of the antenna unit 3 can be substantially completely avoided.

As described above, in the antenna device of the present embodiment, the three antenna units 3 to 5 can be densely mounted in a small antenna mounting area without interference among them. Thus, high-density mounting of components and compactness of the antenna device 1 can be achieved.

Figure 11:
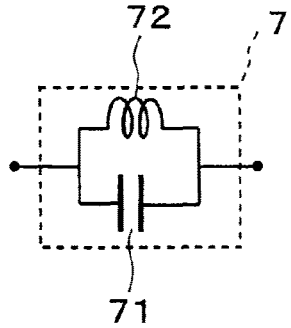
FIG. 11 is a circuit diagram illustrating a modification of the reactance circuit used in the first embodiment.

As illustrated in FIG. 4, in the present embodiment, a series resonant circuit including the capacitor 71 and the inductor 72 is used as the reactance circuit 7. However, as illustrated in FIG. 11, a parallel resonant circuit including the capacitor 71 and the inductor 72 may be used as the reactance circuit 7.

Figure 12:
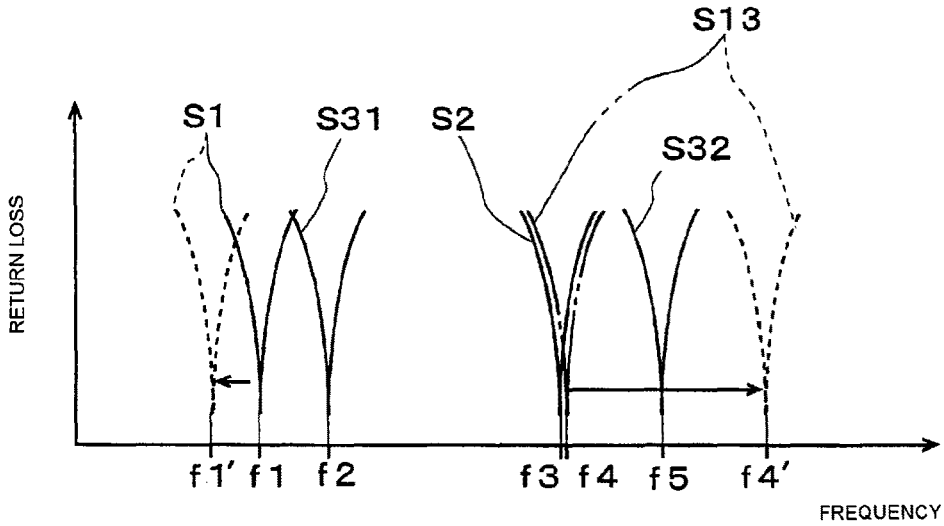
FIG. 12 is a graph for illustrating changes in harmonics, the changes being associated with use of a parallel resonant circuit.

By increasing the reactance of the series resonant circuit used in the present embodiment, the harmonic frequency f4 in the antenna unit 3 can be shifted to lower values, as shown in FIG. 7. On the other hand, by increasing the reactance of a parallel resonant circuit, the harmonic frequency f4 in the antenna unit 3 can be shifted to higher values, as shown in FIG. 12. Therefore, depending on the arrangement of a plurality of antenna units of the antenna device 1, either one of a series resonant circuit and a parallel resonant circuit can be used as the reactance circuit 7.

The reactance circuit 7 may be either a series resonant circuit or a parallel resonant circuit, as long as the circuit includes one or more capacitors and one or more inductors, and is not limited to one specific series resonant circuit or parallel resonant circuit. A reactance circuit formed by combining the series resonant circuit of FIG. 4 and the parallel resonant circuit of FIG. 11 may also be used as the reactance circuit 7.

Second Embodiment

Next, a second embodiment will be described.

Figure 13:
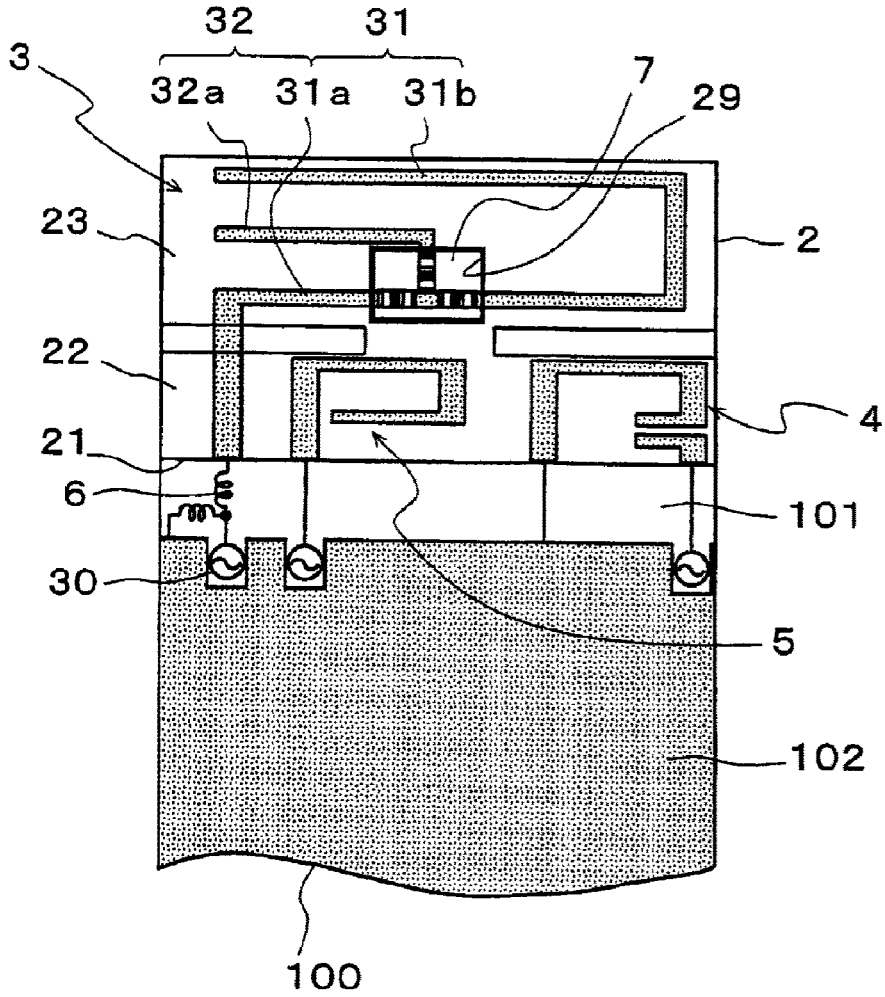
FIG. 13 is a plan view of an antenna device according to a second embodiment of the present invention.
Figure 14:
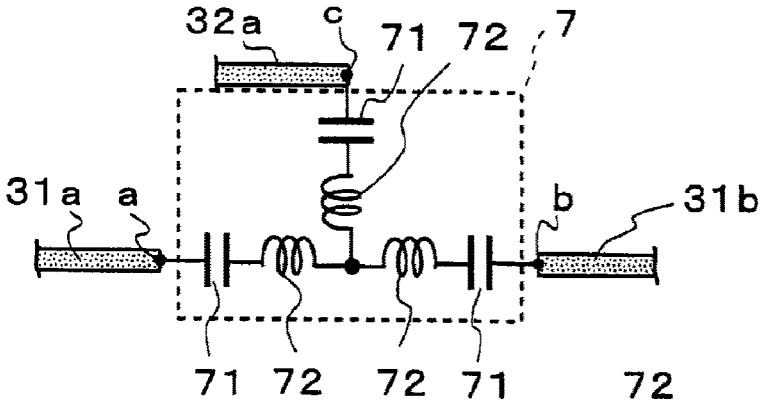
FIG. 14 is a circuit diagram illustrating a reactance circuit of the second embodiment.

FIG. 13 is a plan view of an antenna device according to the second embodiment. FIG. 14 is a circuit diagram illustrating the reactance circuit 7 of the second embodiment.

The antenna device of the present embodiment is different from that of the first embodiment in that a branched radiation electrode 32*a* is added to the antenna unit 3.

Specifically, as illustrated in FIG. 13, the branched radiation electrode 32*a* is horizontally formed on the inclined surface 23 of the dielectric base 2 and connected to the reactance circuit 7. Then, the reactance circuit 7 is configured to allow the branched radiation electrode 32*a* to be connected to the base portion 31*a* of the radiation electrode 31.

Specifically, as illustrated in FIG. 14, two series resonant circuits reversely oriented with respect to each other, each series resonant circuit including the capacitor 71 and the inductor 72, are connected to each other. Then, another series resonant circuit having the same configuration as that of the other two series resonant circuits is connected to a point of connection between the two series resonant circuits to form the reactance circuit 7. Then, the base portion 31*a* of the radiation electrode 31, the extremity portion 31*b* of the radiation electrode 31, and the branched radiation electrode 32*a* are connected to three open ends a, b, and c, respectively.

That is, as illustrated in FIG. 13, in addition to the original radiation electrode 31, a radiation electrode 32 including the base portion 31*a* of the radiation electrode 31 and the branched radiation electrode 32*a* is connected to the power feeder 30, and thus the antenna unit 3 of dual-resonant type is formed.

Figure 15:
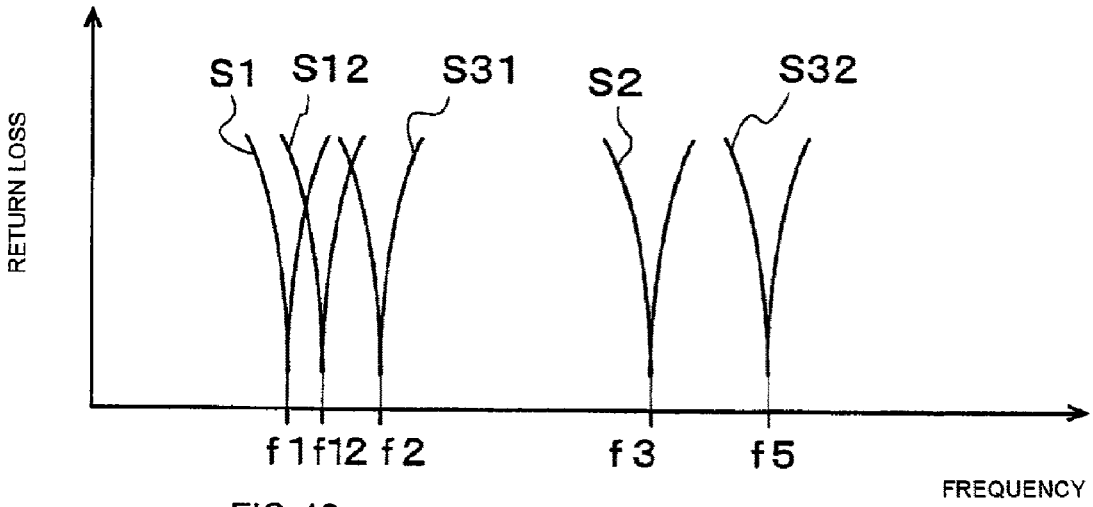
FIG. 15 is a graph showing return losses of antenna units in the antenna device of the second embodiment.

FIG. 15 is a graph showing return losses of the antenna units in the antenna device of the present embodiment.

As shown in FIG. 15, since the antenna unit 3 is configured as a dual-resonant antenna unit, a frequency f12 (return loss curve S12) between the fundamental frequency f1 (return loss curve S1) and the fundamental frequency f3 of the antenna unit 4, as well as the fundamental frequency f1, can be obtained.

Since the bandwidth of the antenna unit 3 can thus be increased, a wideband antenna device can be realized. Although a size reduction of an antenna unit may lead to a narrow bandwidth, such a disadvantage can be overcome by increasing the bandwidth of the antenna unit, as in the case of the present embodiment.

Figure 16:
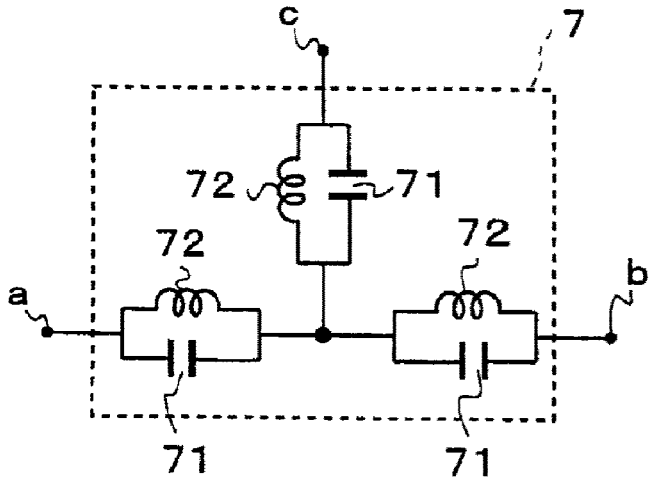
FIG. 16 is a circuit diagram illustrating a modification of the reactance circuit used in the second embodiment.

As illustrated in FIG. 14, in the present embodiment, a series resonant circuit formed by combining three series resonant circuits, each including the capacitor 71 and the inductor 72, is used as the reactance circuit 7. However, as illustrated in FIG. 16, a parallel resonant circuit formed by combining three parallel resonant circuits, each including the capacitor 71 and the inductor 72, may be used as the reactance circuit 7, so that the amount of change in the reactance value of the reactance circuit 7 can be increased.

Again, the reactance circuit 7 may be either a series resonant circuit or a parallel resonant circuit, as long as the circuit includes one or more capacitors and one or more inductors. A reactance circuit formed by combining the series resonant circuit of FIG. 14 and the parallel resonant circuit of FIG. 16 may also be used as the reactance circuit 7.

The other configurations, operations, and effects of the present embodiment are the same as those of the first embodiment, and thus their description will be omitted.

Third Embodiment

Next, a third embodiment will be described.

Figure 17:
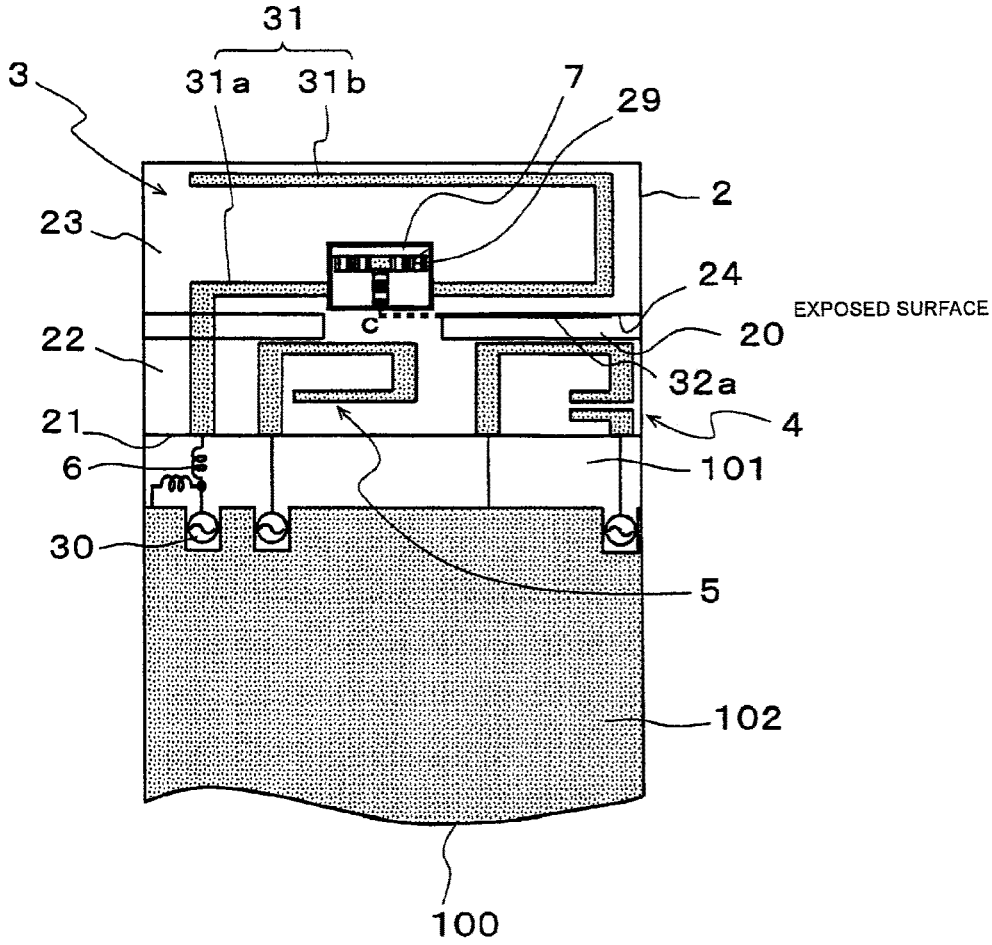
FIG. 17 is a plan view of an antenna device according to a third embodiment of the present invention.
Figure 18:
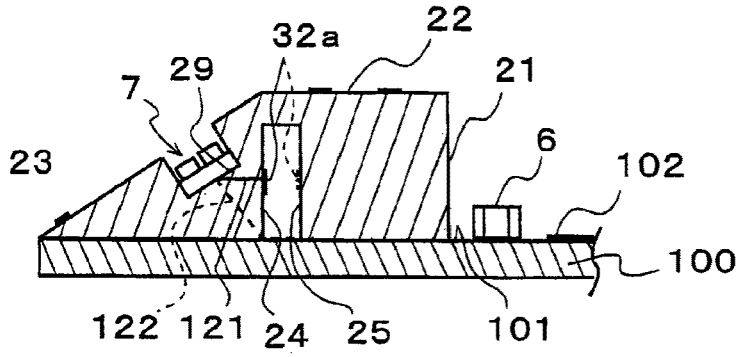
FIG. 18 is a partial enlarged cross-sectional view of the antenna device.

FIG. 17 is a plan view of an antenna device according to the third embodiment of the present invention. FIG. 18 is a partial enlarged cross-sectional view of the antenna device.

The present embodiment is different from the second embodiment in that the branched radiation electrode 32*a* is disposed not on the inclined surface 23 of the dielectric base 2, but on any exposed surface.

Specifically, as illustrated in FIG. 17 and FIG. 18, the branched radiation electrode 32*a* is horizontally disposed on an exposed surface 24 which is an exposed surface of the dielectric base 2 and on which the radiation electrodes 31, 41, and 51 of the antenna units 3, 4, and 5, respectively, are not disposed. Then, a conductive path 121 is connected to the open end c (see FIG. 16) of the reactance circuit 7, extends from the bottom of the recess 29 to the exposed surface 24 which is an inner surface of the notch 20, and then is connected to an end of the branched radiation electrode 32*a*.

Since the branched radiation electrode 32*a* is disposed on the surface where the radiation electrodes 31, 41, and 51 are not disposed, the degree of freedom of arrangement of the branched radiation electrode 32*a* is increased.

In the present embodiment, the branched radiation electrode 32*a* is disposed on the exposed surface 24 of the dielectric base 2. However, as indicated by dashed lines in FIG. 18, the branched radiation electrode 32*a* may be disposed on an exposed surface 25 opposite the exposed surface 24 and connected to the reactance circuit 7 via a conductive path 122.

Besides the branched radiation electrode 32*a*, the extremity portion 31*b* of the radiation electrode 31 and the like may also be disposed on any exposed surface.

Also, by providing many electrodes branched from the radiation electrode 41 on the exposed surfaces 24 and 25, a compact multi-resonant antenna device can be realized.

The other configurations, operations, and effects of the present embodiment are the same as those of the second embodiment, and thus their description will be omitted.

Fourth Embodiment

Next, a fourth embodiment of the present invention will be described.

Figure 19:
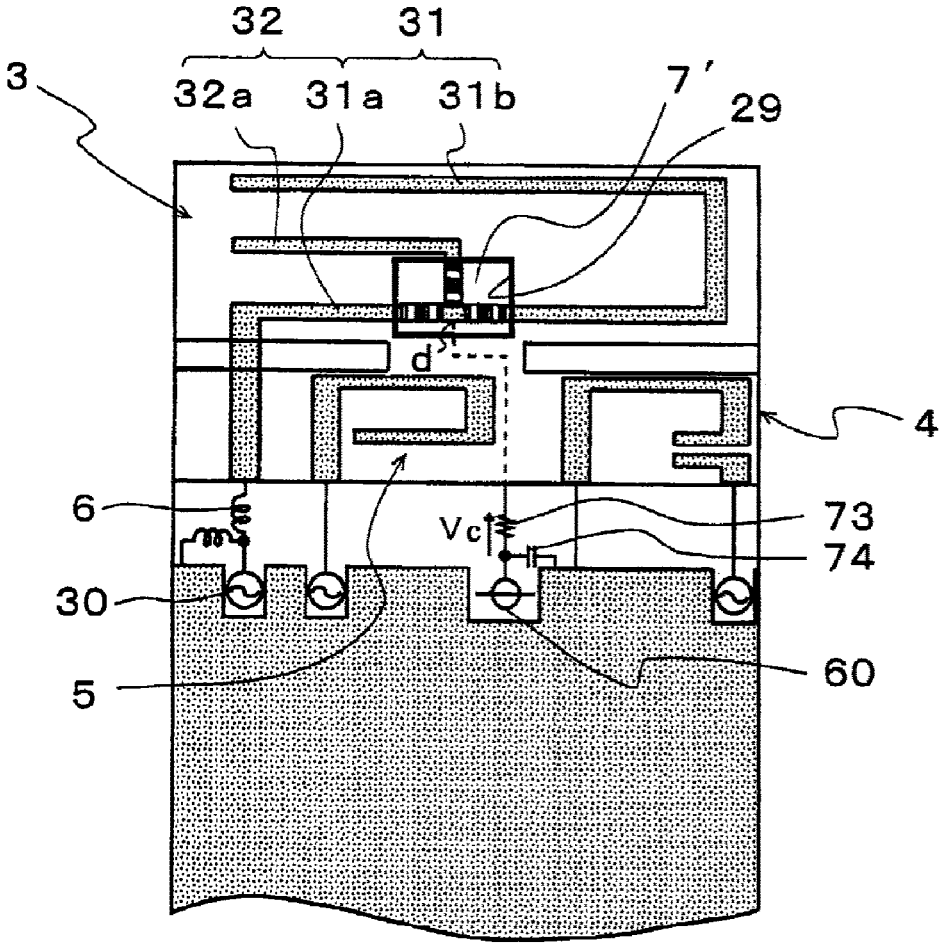
FIG. 19 is a plan view of an antenna device according to a fourth embodiment of the present invention.
Figure 20:
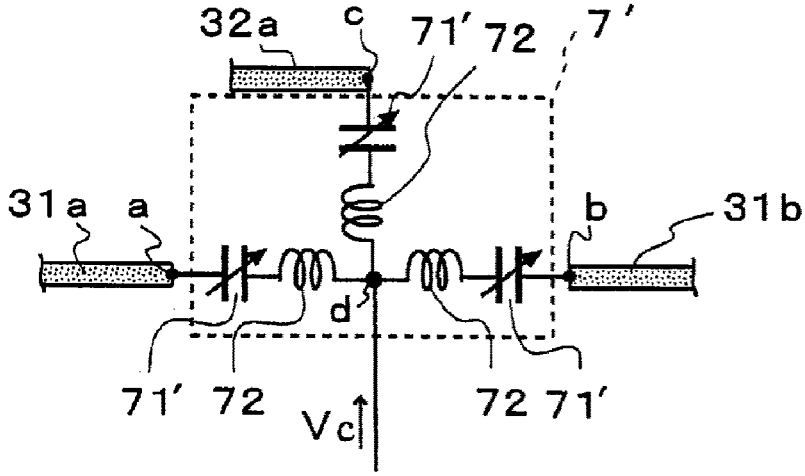
FIG. 20 is a circuit diagram illustrating a reactance circuit of the fourth embodiment.

FIG. 19 is a plan view of an antenna device according to the fourth embodiment of the present invention. FIG. 20 is a circuit diagram illustrating the reactance circuit 7 of the present embodiment.

The present embodiment is different from the second embodiment in that a variable capacitance element is included in the reactance circuit.

That is, as illustrated in FIG. 19, a reactance circuit 7' including variable capacitance elements is inserted into the recess 29 to form a dual-resonant structure. At the same time, by using a control voltage Vc to vary the reactance value of the reactance circuit 7', each resonant frequency can be changed later on.

Specifically, in the reactance circuit 7 illustrated in FIG. 14, all the capacitors 71 are replaced with variable capacitance capacitors 71' serving as variable capacitance elements to form the reactance circuit 7' illustrated in FIG. 20. Then, a direct-current power supply 60 for the control voltage Vc is connected to a connection point d of the three inductors 72 via a resistor 73 for cutting harmonics. Reference numeral 74 denotes a capacitor for allowing harmonics to pass through.

Like the antenna device of the second embodiment, the antenna device of the present embodiment is a dual-resonant antenna in which resonance occurs, via the reactance circuit 7', in the antenna unit including the base portion 31*a* and extremity portion 31*b* of the radiation electrode 31 and the power feeder 30 and in the antenna unit including the base portion 31*a* of the radiation electrode 31, the branched radiation electrode 32*a*, and the power feeder 30.

Thus, by applying, from the direct-current power supply 60, the control voltage Vc having a predetermined value to the variable capacitance capacitors 71' in the reactance circuit 7', the capacitance values of the respective variable capacitance capacitors 71' can be varied, and thus the electrical length of the radiation electrode 31 including the base portion 31*a* and the extremity portion 31*b* and the electrical length of the radiation electrode 32 including the base portion 31*a* of the radiation electrode 31 and the branched radiation electrode 32*a* can be varied.

Figure 21:
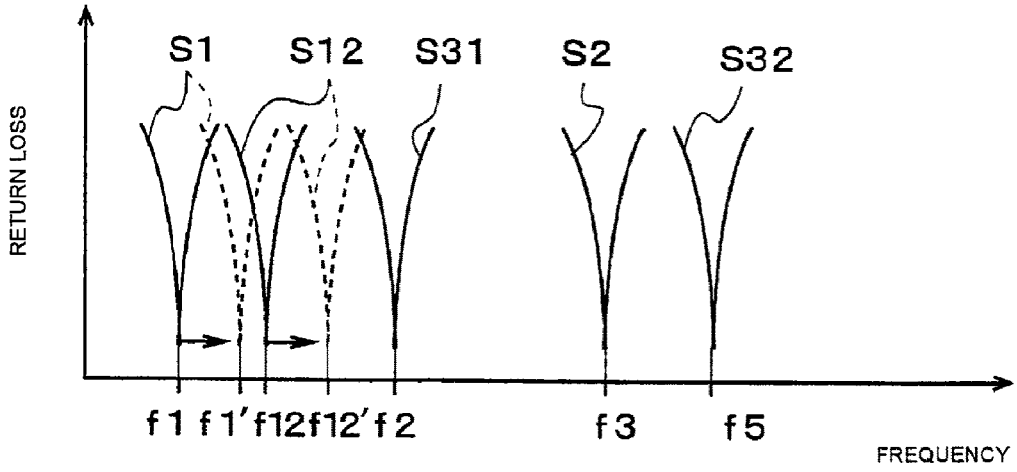
FIG. 21 is a graph for illustrating frequency changes associated with use of the reactance circuit of the fourth embodiment.

FIG. 21 is a graph for illustrating frequency changes associated with use of the reactance circuit 7'.

As described above, by using the control voltage Vc to vary the reactance values of the reactance circuits 7' and the electrical lengths of the radiation electrode 31 and radiation electrode 32, the fundamental frequency f1 (return loss curve S1) and the frequency f12 (return loss curve S12) for dual-resonance can be shifted to a fundamental frequency f1' and a frequency f12', respectively, as indicated by dashed lines in FIG. 21.

Thus, unlike the antenna device of the second embodiment, in the antenna device of the present embodiment, since frequencies can be changed even after insertion of the reactance circuit 7' into the recess 29, an individual adjustment corresponding to each product can be made. At the same time, since the fundamental frequency f1 and the frequency f2 for dual-resonance can be varied, a bandwidth wider than that of the antenna device of the second embodiment can be ensured.

In the present embodiment, the reactance circuit 7' is composed of three series resonant circuits, each including the variable capacitance capacitor 71' and the inductor 72. However, the reactance circuit 7' may be composed of three parallel resonant circuits, each including the variable capacitance capacitor 71' and the inductor 72. Alternatively, the reactance circuit 7' may be formed by combining series and parallel resonant circuits.

At the same time, when any one or more capacitors in the reactance circuit are replaced with one or more variable capacitance elements, such as the variable capacitance capacitors 71', the reactance value of the reactance circuit can be changed by application of a control voltage. For example, instead of replacing all the capacitors 71 of FIG. 14 with the variable capacitance capacitors 71', one or two capacitors 71 may be replaced with one or two variable capacitance capacitors 71'. Moreover, instead of the variable capacitance capacitor 71', a variable capacitance diode, a micro electro mechanical systems (MEMS) element, a barium-strontium-titanate (BST (ferroelectric material)) element, or the like may be used as a variable capacitance element. In other words, any element can be used as long as the element is capable of controlling the capacitance value with a direct-current control voltage.

It should be understood that the present embodiment can also be modified, as in the case of the third embodiment.

The other configurations, operations, and effects of the present embodiment are the same as those of the first to third embodiments, and thus their description will be omitted.

The present invention is not limited to the above-described embodiments and their modifications, but can be variously modified and changed within the scope of the present invention.

For example, in the embodiments described above, the non-ground region 101 serves as an antenna mounting area, and the dielectric base 2 is mounted on the non-ground region 101. However, the antenna mounting area refers not only to the non-ground region, but also refers to all mounting areas including the ground region 102. Therefore, an embodiment in which antenna units for different systems are disposed on the backside of the non-ground region 101 and/or on the ground region 102 is also included in the scope of the present invention.

Also, in the embodiments described above, the radiation electrodes 31, 41, and 51 of the antenna units 3, 4, and 5, respectively, and the branched radiation electrode 32*a* are mostly formed on the dielectric base 2. However, an embodiment of an antenna device in which the radiation electrodes 31, 41, and 51 of the antenna units 3, 4, and 5, respectively, and the branched radiation electrode 32*a* are partially formed on the dielectric base 2 and mostly formed, as a pattern, on the non-ground region 101 or on another region may also included in the scope of the present invention.

In the embodiments described above, the radiation electrode 31 and the like are formed on the single dielectric base 2. However, an embodiment in which radiation electrodes of respective antenna units are formed on a plurality of different dielectric bases is not to be excluded from the scope of the present invention.

Moreover, although there are three antenna units 3 to 5 in the embodiments described above, an embodiment of an antenna device having four or more antenna units corresponding to four or more different systems is also within the scope of the present invention.

Although the current-density control coil 6 is used as a current-density control circuit in the embodiments described above, any circuit capable of controlling the current density in the antenna unit 3 can be used.

In the embodiments described above, a magnetic-field radiation antenna is used as the antenna unit 4 serving as a second antenna unit. However, the type of antenna is not limited to this. Any type of antenna, including a monopole antenna, can be used as the antenna unit 4.

Although one branched radiation electrode 32*a* is added in the second to fourth embodiments described above, it should be understood that the number of branched radiation electrodes is not limited to this.

Although particular embodiments have been described, many other variations and modifications and other uses will become apparent to those skilled in the art. Therefore, the present invention is not limited by the specific disclosure herein.

What is claimed is:

1. An antenna device comprising:

a plurality of antenna units each including an independent power feeder and a respective radiation electrode;

a circuit board including an antenna mounting area on which the plurality of antenna units are mounted; and a dielectric base on which at least one of the respective radiation electrodes of the plurality of antenna units is provided; wherein of the plurality of antenna units, a first antenna unit having a lowest fundamental frequency is disposed at an end of the antenna mounting area;

a second antenna unit having a highest fundamental frequency of the plurality of antenna units is disposed at a greater distance from the first antenna unit than a distance by which another one or more of the plurality of antenna units are separated from the first antenna unit;

the another one or more of the plurality of antenna units are interposed between the first and second antenna units and in parallel therewith;

in the first antenna unit, a current-density control circuit capable of controlling a current density in the respective radiation electrode is interposed between the respective radiation electrode and the independent power feeder, and a reactance circuit arranged to adjust a frequency by varying an electrical length of the respective radiation electrode of the first antenna unit is disposed in a middle portion of the respective radiation electrode;

a recess is provided on a surface of the dielectric base; and a substrate on which the reactance circuit is provided is disposed inside the recess.

2. The antenna device according to claim 1, wherein at least one of the respective radiation electrodes of the plurality of antenna units is provided on the dielectric base, and at least one notch to reduce capacitance between the respective radiation electrodes of two or more of the first antenna unit, the second antenna unit, and the another one or more of the plurality of antenna units is disposed at a portion of the dielectric base and between the respective radiation electrodes.

3. The antenna device according to claim 1, wherein the current-density control circuit is a current-density control coil connected in series between the independent power feeder and the respective radiation electrode of the first antenna unit.

4. The antenna device according to claim 1, wherein the reactance circuit is a series resonant circuit or a parallel resonant circuit and includes one or more capacitors and one or more inductors.

5. The antenna device according to claim 4, wherein at least one of the one or more capacitors in the reactance circuit is a variable capacitance element, and an input is provided to apply a control voltage to vary a capacitance value of the variable capacitance element, vary a reactance value of the reactance circuit, and thus vary the electrical length of the respective radiation electrode of the first antenna unit.

6. The antenna device according to any one of claim 1, 4, or 5, wherein at least one branched radiation electrode is branched from the respective radiation electrode of the first antenna unit via the reactance circuit, and at least a portion of the at least one branched radiation electrode is disposed on the dielectric base.

7. The antenna device according to claim 6, wherein at least one of a portion of the respective radiation electrode of the first antenna unit extending from the reactance circuit and being adjacent to an extremity of the antenna device, or the at least one branched radiation electrode, is disposed on an exposed surface of the dielectric base, and the portion of the respective radiation electrode of the first antenna unit or the at least one branched radiation electrode is electrically connected to the reactance circuit via a conductive path extending from a bottom of the recess to the exposed surface.

8. A wireless communication apparatus comprising:

the antenna device according to claim 1; and a plurality of RF sources connected respectively to the independent power feeders corresponding to the plurality of antenna units.

* * * * *